US011663984B2

(12) United States Patent
Jia

(10) Patent No.: US 11,663,984 B2
(45) Date of Patent: May 30, 2023

(54) METHOD AND DEVICE FOR ADJUSTING BRIGHTNESS, AND STORAGE MEDIUM

(71) Applicant: BEIJING XIAOMI MOBILE SOFTWARE CO., LTD., Beijing (CN)

(72) Inventor: Yongqiang Jia, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 17/240,945

(22) Filed: Apr. 26, 2021

(65) Prior Publication Data

US 2022/0059040 A1 Feb. 24, 2022

(51) Int. Cl.
*G09G 3/34* (2006.01)
*G09G 5/10* (2006.01)

(52) U.S. Cl.
CPC ..... *G09G 3/3406* (2013.01); *G09G 5/10* (2013.01); *G09G 2320/0233* (2013.01); *G09G 2320/0653* (2013.01); *G09G 2360/144* (2013.01); *G09G 2360/16* (2013.01)

(58) Field of Classification Search
None
See application file for complete search history.

(56) References Cited

U.S. PATENT DOCUMENTS

| | | | | |
|---|---|---|---|---|
| 6,411,306 | B1 | 6/2002 | Miller et al. | |
| 10,504,456 | B2 * | 12/2019 | Inokawa | G09G 3/3225 |
| 2002/0024529 | A1 | 2/2002 | Miller et al. | |
| 2005/0024538 | A1 | 2/2005 | Park et al. | |
| 2009/0079721 | A1 * | 3/2009 | Gettemy | G09G 3/3406 345/207 |
| 2009/0262128 | A1 | 10/2009 | Gettemy | |
| 2014/0365912 | A1 * | 12/2014 | Shaw | G06F 3/0488 715/748 |
| 2017/0039994 | A1 * | 2/2017 | Wu | G09G 5/10 |
| 2017/0206860 | A1 | 7/2017 | Wu | |
| 2017/0243548 | A1 * | 8/2017 | Wang | G09G 3/20 |
| 2020/0202800 | A1 * | 6/2020 | Kang | G09G 3/20 |

FOREIGN PATENT DOCUMENTS

| | | | |
|---|---|---|---|
| CN | 105976760 | A | 9/2016 |
| CN | 106997744 | A | 8/2017 |
| CN | 109326244 | A | 2/2019 |
| JP | 2011227324 | A | 11/2011 |

OTHER PUBLICATIONS

Extended European Search Report in European Application No. 21170403.6, dated Oct. 19, 2021, (10p).
CNOA of the Application No. 202010847933.X dated Jul. 19, 2022, with English translation(17p).

* cited by examiner

*Primary Examiner* — Andre L Matthews
(74) *Attorney, Agent, or Firm* — Arch & Lake LLP

(57) ABSTRACT

A method and a device for adjusting brightness are provided. The method includes that: when a change in ambient brightness is detected, a target screen brightness a screen is to achieve is acquired. An adjustment parameter for adjusting the screen from current screen brightness to the target screen brightness is determined based on the target screen brightness. The adjustment parameter includes at least an adjustment duration. While adjusting screen brightness, change progress information of the screen brightness is displayed synchronously on an interface displayed on the screen, according to the adjustment duration in the adjustment parameter.

16 Claims, 5 Drawing Sheets

METHOD AND DEVICE FOR ADJUSTING BRIGHTNESS, AND STORAGE MEDIUM

CROSS-REFERENCE TO RELATED APPLICATIONS

This application is based on and claims priority to Chinese Patent Application No. 202010847933.X filed on Aug. 21, 2020, the contents of which are incorporated herein by reference in their entirety for all purposes.

BACKGROUND

With popularization of mobile equipment, an Android operating system carried by mobile equipment has become the most widely used mobile operating system in the world. The Android open source allows a manufacturer to perform in-depth customization and develop a unique function of the manufacturer to satisfy a user, especially customization of a function at a framework layer, which plays a link role in the entire operating system.

SUMMARY

The present disclosure may relate to the field of brightness control. The present disclosure provides a method and device for adjusting brightness, and a storage medium.

According to a first aspect of embodiments of the present disclosure, there is provided a method for adjusting brightness. The method includes acquiring a target screen brightness in response to detecting a change in ambient brightness. Additionally, the method includes determining, based on the target screen brightness, an adjustment parameter for adjusting from current screen brightness to the target screen brightness. The adjustment parameter includes at least an adjustment duration. Further, the method includes in response to adjusting screen brightness, synchronously displaying, according to the adjustment duration in the adjustment parameter, change progress information of the screen brightness on an interface displayed on the screen.

According to a second aspect of the embodiments of the present disclosure, there is provided a device for adjusting brightness. The device includes a processor, and a memory for storing processor executable instructions. The processor is configured to implement acts including acquiring a target screen brightness in response to detecting a change in ambient brightness and determining, based on the target screen brightness, an adjustment parameter for adjusting from current screen brightness to the target screen brightness. The adjustment parameter includes at least an adjustment duration. Further, the processor is configured to implement acts further including in response to adjusting screen brightness, synchronously displaying, according to the adjustment duration in the adjustment parameter, change progress information of the screen brightness on an interface displayed on the screen.

According to a third aspect of the embodiments of the present disclosure, there is provided a non-transitory computer-readable storage medium having stored therein computer-executable instructions which, when executed by a processor, implement acts including acquiring a target screen brightness in response to detecting a change in ambient brightness and determining, based on the target screen brightness, an adjustment parameter for adjusting from current screen brightness to the target screen brightness. The adjustment parameter includes at least an adjustment duration. Further, the computer-executable instructions which, when executed by a processor, implement acts further including in response to adjusting screen brightness, synchronously displaying, according to the adjustment duration in the adjustment parameter, change progress information of the screen brightness on an interface displayed on the screen.

It should be understood that the general description above and the elaboration below are illustrative and explanatory only, and do not limit the present disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Figure 1:
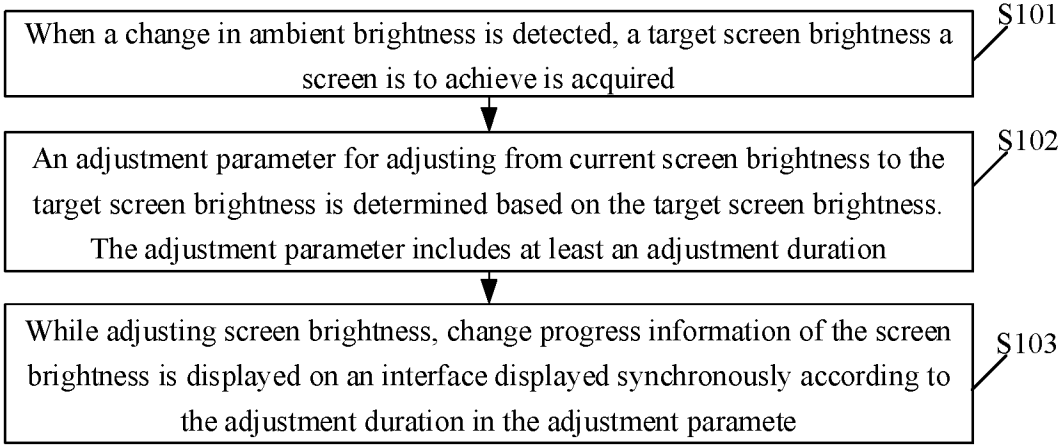
FIG. 1 is a flowchart of a method for adjusting brightness according to an illustrative embodiment.

Reference will now be made in detail to illustrative embodiments, examples of which are illustrated in the accompanying drawings. The following description refers to the accompanying drawings in which the same numbers in different drawings represent the same or similar elements unless otherwise represented. The implementations set forth in the following description of illustrative embodiments do not represent all implementations consistent with the disclosure. Instead, they are merely examples of devices and methods consistent with aspects related to the disclosure as recited in the appended claims. The illustrative implementation modes may take on multiple forms, and should not be taken as being limited to examples illustrated herein. Instead, by providing such implementation modes, embodiments herein may become more comprehensive and complete, and comprehensive concept of the illustrative implementation modes may be delivered to those skilled in the art. Implementations set forth in the following illustrative embodiments do not represent all implementations in accordance with the subject disclosure. Rather, they are merely examples of the apparatus and method in accordance with certain aspects herein as recited in the accompanying claims.

Note that although a term such as first, second, third may be adopted in an embodiment herein to describe various kinds of information, such information should not be limited to such a term. Such a term is merely for distinguishing information of the same type. For example, without departing from the scope of the embodiments herein, the first information may also be referred to as the second information. Similarly, the second information may also be referred to as the first information. Depending on the context, a "if" as used herein may be interpreted as "when" or "while" or "in response to determining that".

In addition, described characteristics, structures or features may be combined in one or more implementation modes in any proper manner. In the following descriptions, many details are provided to allow a full understanding of embodiments herein. However, those skilled in the art will know that the technical solutions of embodiments herein may be carried out without one or more of the details; alternatively, another method, component, device, option, etc., may be adopted. Under other conditions, no detail of a known structure, method, device, implementation, material or operation may be shown or described to avoid obscuring aspects of embodiments herein.

A block diagram shown in the accompanying drawings may be a functional entity which may not necessarily correspond to a physically or logically independent entity. Such a functional entity may be implemented in form of software, in one or more hardware modules or integrated circuits, or in different networks and/or processor devices and/or microcontroller devices.

A terminal may sometimes be referred to as a smart terminal. The terminal may be a mobile terminal. The terminal may also be referred to as User Equipment (UE), a Mobile Station (MS), etc. A terminal may be equipment or a chip provided therein that provides a user with a voice and/or data connection, such as handheld equipment, onboard equipment, etc., with a wireless connection function. Examples of a terminal may include a mobile phone, a tablet computer, a notebook computer, a palm computer, a Mobile Internet Device (MID), wearable equipment, Virtual Reality (VR) equipment, Augmented Reality (AR) equipment, a wireless terminal in industrial control, a wireless terminal in unmanned drive, a wireless terminal in remote surgery, a wireless terminal in a smart grid, a wireless terminal in transportation safety, a wireless terminal in smart city, a wireless terminal in smart home, etc.

With popularization of mobile equipment, an Android operating system carried by mobile equipment has become the most widely used mobile operating system in the world. The Android open source allows a manufacturer to perform in-depth customization and develop a unique function of the manufacturer to satisfy a user, especially customization of a function at a framework layer, which plays a link role in the entire operating system. However, in an existing screen brightness solution of the operating system, change progress information representing a change in brightness on a screen is not synchronized with the actual brightness setting, and further improvement is required to improve the user experience.

Embodiments of the present disclosure provide a method for adjusting brightness. FIG. 1 is a flowchart of a method for adjusting brightness according to an illustrative embodiment. As shown in FIG. 1, the method includes steps as follows.

In S101, when a change in ambient brightness is detected, a target screen brightness a screen is to achieve is acquired.

In S102, an adjustment parameter for adjusting from current screen brightness to the target screen brightness is determined based on the target screen brightness. The adjustment parameter includes at least an adjustment duration.

In S103, while adjusting screen brightness, change progress information of the screen brightness is displayed synchronously on an interface displayed, according to the adjustment duration in the adjustment parameter.

It should be noted that the method for adjusting brightness may be applied to any electronic equipment on which an Android operating system is mounted, such as a smartphone, a smart watch, a tablet computer, etc.

It should be noted that the Android operating system includes at least a framework layer and an application layer.

The reason that on-screen change progress information representing the change in the screen brightness is not synchronized with the actual automatic brightness setting is because in the native code of an Android operating system, the automatic brightness setting is actually out of sync with transition of a brightness progress bar in a status bar or settings. In a system user interface (UI) process, progress transition of the progress bar is performed using a Value Animator. The duration of the Value Animator is fixed to be 3 seconds. That is, the change in the brightness progress bar in the status bar or the settings will be completed within 3 seconds regardless of the amplitude of the brightness setting. When the actual screen brightness is set at the framework layer, screen brightness is animated by determining a change in brightness through a given brightness change rate and a screen frame update time, and then progressively increasing or decreasing by the change in brightness. Therefore, duration of animation of the screen brightness set by the framework layer will not be fixed, but may differ, depending on the brightness change rate. In this case, the change in the screen brightness is not synchronized with the change in the brightness progress bar.

In order to synchronize the change in the screen brightness and the change in the brightness progress bar, it is proposed in embodiments of the present disclosure that, as the screen brightness will change corresponding to a change in ambient brightness, it is possible to determine in advance an adjustment parameter (e.g., an adjustment duration) for adjusting from previous screen brightness to the target screen brightness, and inform the brightness progress bar of the adjustment parameter, so that the brightness progress bar may achieve synchronization by performing transition according to the adjustment parameter.

Note that screen brightness of the electronic equipment may be adjusted, including automatic brightness adjustment triggered by detected ambient brightness and passive brightness adjustment triggered by a detected touch operation. Embodiments of the present disclosure may be directed at automatic brightness adjustment triggered by detected ambient brightness, that is, adjustment of screen brightness adaptive to changing ambient brightness. In this case, further adjustment is made to also display change progress information of the brightness synchronously on the interface displayed, while the screen brightness changes. For example, when the screen brightness changes, the brightness progress bar on the interface displayed also changes synchronously, matching the change in the screen brightness, bringing about a more intuitive user experience of the change in brightness.

When the screen is off, if ambient brightness changes, screen brightness corresponding to the change in ambient brightness will also be acquired. When the screen lights up, display will be performed directly with last screen brightness acquired before the screen lights up. Meanwhile, a progress location corresponding to the last screen brightness is also displayed on the brightness progress bar, however with no animation of the progress change. In the case of the off screen lighting up again, even if the brightness progress bar is to be displayed, only the progress location at the lighting-up even will show, and the user cannot perceive the change in the screen brightness through the location of the progress bar. It is meaningless to display the brightness progress bar again at this point. Therefore, embodiments of the present disclosure do not apply to brightness adjustment in the case of the off screen lighting up again. Thus, embodiments of the present disclosure are directed at automatic brightness adjustment triggered by detected ambient brightness, specifically in a screen on state.

Here, change progress information of display brightness may be reflected by a brightness adjusting control located on the interface displayed. The brightness adjusting control may include a brightness progress bar, or a brightness progress ball.

Here, the synchronization includes synchronization in terms of time or an adjustment direction.

Time synchronization refers to that adjustment time for the change in the screen brightness is the same as adjustment time for the change in the change progress information of the display brightness on the interface displayed. For example, if the adjustment time for the change in the screen brightness is 3 ms, then the change in the progress of the brightness progress bar on the interface displayed also takes 3 ms.

Adjustment direction synchronization refers to that an adjustment direction for the change in the screen brightness is the same as an adjustment direction for the change in the change progress information of the display brightness on the interface displayed. For example, if the adjustment direction for the change in the screen brightness is brightness increase, then the direction of change in the progress of the brightness progress bar on the interface displayed is the direction representing brightness increase. On the brightness progress bar, if adjustment to the left is brightness decrease and adjustment to the right is brightness increase, then the brightness progress bar is adjusted to the right if the adjustment direction for the change in the screen brightness is brightness increase.

In the embodiment of the present disclosure, the adjustment parameter includes at least an adjustment duration. In other embodiments, the adjustment parameter further includes an adjustment direction.

The adjustment duration may indicate a total amount of time required to adjust from the current screen brightness to the target screen brightness. The adjustment direction may reflect a direction of change in the brightness, including a brightness increase direction or a brightness decrease direction.

There is a process of change for the change in the screen brightness. The process will involve a time parameter and a direction parameter. Then, change information may be determined upon knowing the time parameter and the direction parameter. In this case, change progress information of display brightness on the interface displayed may be displayed synchronously by also using the time parameter and the direction parameter.

Further, the electronic equipment includes a brightness sensor and a processor. The brightness sensor is configured to detect the ambient brightness, and the processor is configured to determine, based on the ambient brightness, whether there is a change in the ambient brightness of the space in which the electronic equipment is located.

In some embodiments, the method further a step as follows.

A framework layer may transmit the adjustment parameter to an application layer process of the interface displayed on the screen.

While adjusting the screen brightness, the change progress information of the screen brightness may be displayed synchronously on the interface displayed, according to the adjustment duration in the adjustment parameter, as follows.

While adjusting the screen brightness, the application layer process may synchronously display the change progress information of the screen brightness on the interface displayed, according to the adjustment duration in the adjustment parameter.

After detecting the ambient brightness through the brightness sensor, the electronic equipment may transmit the ambient brightness to the processor. The processor may determine whether there is a change in the ambient brightness of the space in which the electronic equipment is located by comparing values of ambient brightness detected by two consecutive detections. When it is determined that there is a change, the processor may determine a target screen brightness the screen is to achieve corresponding to adaptation of the screen to the change in the ambient brightness, and transmit the target screen brightness to the framework layer through a hardware interface, so that the framework layer acquires the target screen brightness.

Note that a correspondence between the ambient brightness and the screen brightness may be stored in the electronic equipment in advance. When it is determined that there is a change in the ambient brightness, the target screen brightness the screen is to achieve may be determined based on the correspondence.

Here, having acquired the target screen brightness, the framework layer may further determine, based on the target screen brightness, the adjustment parameter for adjusting from the current screen brightness to the target screen brightness.

The change progress information of the screen brightness may be represented by a brightness adjusting control (e.g., a brightness progress bar). The brightness progress bar is located on the interface displayed, and processed by the system UI process of the application layer. Then, in order to implement synchronization, the adjustment parameter determined by the framework layer may have to be transmitted to the application layer process of the interface displayed. In this way, the application layer process may synchronously display change progress information of the screen brightness on an interface displayed, according to the adjustment duration in the adjustment parameter while adjusting screen brightness. After determining the adjustment parameter, the framework layer may transmit, through an interface call, component information delivery, etc., the adjustment parameter to the application layer process of the interface displayed on the screen. Thus, after acquiring the adjustment parameter, the application layer process may adjust, through the adjustment parameter, the change progress information of the display brightness on the interface displayed, such that synchronization of the change progress information of the display brightness on the interface displayed with the actual change in the screen brightness is implemented.

In embodiments of the present disclosure, an application layer process is configured to control display of change progress information of display brightness on an interface displayed, and includes a system interface UI process.

Since an adjustment parameter is a parameter related to the change in the screen brightness, when the application layer process also adjusts, through the adjustment parameter, the change progress information of the display brightness on the interface displayed, it may be ensured that the adjustment of the change progress information of the display brightness on the interface displayed may be synchronized with the actual change in the screen brightness.

In some embodiments, based on the adjustment duration, in S103, while adjusting the screen brightness, the change progress information of the screen brightness may be synchronously displayed on the interface displayed, according to the adjustment duration in the adjustment parameter, as follows.

The change progress information of a duration same as the adjustment duration may be synchronously displayed on the interface displayed, within the adjustment duration of adjusting the screen brightness.

That is, the adjustment duration may be transmitted to the application layer process of the interface displayed, and adjustment may be implemented through the application layer process, so that the change progress information of the display brightness on the interface displayed changes correspondingly within the adjustment duration.

For example, when the change in the screen brightness starts at 8:30:30:20, and completes at 8:30:30:25, the total time required to complete the change is 5 ms. Then, the change progress information of the display brightness displayed on the interface displayed is also synchronized between 8:30:30:20 and 8:30:30:25, taking 5 ms.

Thus, after the adjustment duration has been transmitted to the application layer process of the interface displayed on the screen, the application layer process may adjust, within a duration same as the adjustment duration, the change progress information of the display brightness on the interface displayed, implementing adjustment duration synchronization.

In some embodiments, when the adjustment parameter includes an adjustment duration, in S102, the adjustment parameter for adjusting from the current screen brightness to the target screen brightness may be determined based on the target screen brightness as follows.

A to-be-achieved adjustment amount of the screen brightness may be determined based on the target screen brightness and the current screen brightness.

The adjustment duration required to adjust to the target screen brightness may be determined based on the to-be-achieved adjustment amount and a set brightness change rate.

The target screen brightness refers to the brightness to be achieved which matches the ambient brightness. The current screen brightness refers to the brightness before adjustment. The to-be-achieved adjustment amount of the screen brightness refers to the amount of adjustment required to adjust from the current screen brightness to the target screen brightness.

The to-be-achieved adjustment amount of the screen brightness may be determined based on the target screen brightness and the current screen brightness, as follows. The to-be-achieved adjustment amount of the screen brightness may be determined based on a difference between the target screen brightness and the current screen brightness.

After determining the required to-be-achieved adjustment amount, the adjustment duration required to adjust to the target screen brightness may be determined based on the to-be-achieved adjustment amount and the set brightness change rate, as follows. the adjustment duration required to adjust to the target screen brightness may be determined through a ratio of the to-be-achieved adjustment amount to the set brightness change rate.

Here, the change in the screen brightness is a continuous process. The change in brightness may be presented through a continuous combination of the amount of change in the screen brightness per second.

The brightness change rate refers to the rate of the change in the screen brightness, that is, the amount of change in the screen brightness per second when the brightness changes. The brightness change rate may be determined according to a hardware parameter of the screen.

In some embodiments, the brightness change rate may differ, depending on the type of the screen. That is, one screen corresponds to one brightness change rate.

In other embodiments, different brightness change rates may be supported by the same screen. A brightness change rate may be implemented through corresponding setting.

Thus, after the to-be-achieved adjustment amount has been determined, the adjustment duration required to adjust to the target screen brightness may be determined based on the set brightness change rate, providing a basis for subsequent synchronization adjustment.

In some embodiments, the adjustment parameter further includes an adjustment direction.

The adjustment direction may include a brightness increase direction or a brightness decrease direction.

Regarding the adjustment direction, brightness may be increased in different modes, depending on the type of the brightness adjusting control. For example, since the brightness progress bar is bar-shaped, it may correspond to a mode of increasing the brightness where the adjustment direction is represented by a direction of changing the progress left or right, or up or down, on the brightness progress bar. For example, on a brightness progress bar oriented horizontally, the brightness increase direction is to the right, and the brightness decrease direction is to the left.

Based on the adjustment direction, in S103, while adjusting the screen brightness, the change progress information of the screen brightness may be synchronously displayed on the interface displayed, according to the adjustment duration in the adjustment parameter, as follows.

While the screen brightness is being adjusted, the change progress information of adjusting the screen brightness in the adjustment direction may be synchronously displayed on the interface displayed.

That is, the adjustment direction may be transmitted to the application layer process of the interface displayed, and adjustment may be implemented through the application layer process, so that the change progress information of the display brightness on the interface displayed changes in the same direction as the actual change in the screen brightness. For example, if the screen is changing from dark to light, taking a brightness progress bar with a left-right change direction as an example, the progress of the brightness progress bar displayed on the interface displayed is adjusted from left to right, accordingly.

Thus, after the adjustment direction has been transmitted to the application layer process of the interface displayed on the screen, the application layer process may adjust the change progress information of the display brightness on the interface displayed, in the same direction as the actual change in the screen brightness, implementing adjustment direction synchronization.

In some embodiments, when the adjustment parameter includes an adjustment direction, in S102, the adjustment parameter for adjusting from the current screen brightness to the target screen brightness may be determined based on the target screen brightness, as follows.

The adjustment direction may be determined based on a relation between magnitudes of the target screen brightness and the current screen brightness.

Here, based on the relation between the magnitudes of the target screen brightness and the current screen brightness, it may be determined whether the current adjustment is in the brightness increase direction or in the brightness decrease direction. For example, if the target screen brightness is greater than the current screen brightness, it is considered that the screen is adjusted from dark to light, and the adjustment direction is an brightness increase direction. In this case, the corresponding adjustment mode on the brightness adjusting control may be controlled.

In this way, the adjustment direction may be determined through the relation between the magnitudes of the target screen brightness and the current screen brightness, displaying, on the interface displayed, a change matching the direction of the change in the screen brightness, so that an indication function better matching the actual need may be provided, matching the adjustment on the brightness adjusting control to the actual change in the screen brightness, bringing about a better sensory experience to the user.

In some embodiments, the framework layer may transmit the adjustment parameter to the application layer process of the interface displayed on the screen as follows.

The framework layer may store the adjustment parameter in a target field of a preset data table.

The application layer process may acquire the adjustment parameter by monitoring a value of the target field.

In embodiments of the present disclosure, the application layer process monitors the adjustment parameter. That is, after the framework layer has acquired the target screen brightness the screen is to achieve, and determined the adjustment parameter for adjusting from the current screen brightness to the target screen brightness based on the target screen brightness, the framework layer stores the adjustment parameter in the target field of the preset data table. Thus, since the data table is in the database, a process of the application layer process may determine whether the screen brightness has changed by directly monitoring the corresponding field in the data table in the database, and further acquire a changed value as a monitored value. In this way, it is not required to provide an excessive number of interfaces between the application layer process and the framework layer to acquire data, reducing a development workload.

Here, a data table for storing information appearing in adjustment of the screen brightness may be established in the database in advance. Different fields may be provided in the data table for storing different types of information. For example, a brightness field light may be set to store brightness information of the screen. A time field time is set to store duration information.

For example, taking the adjustment parameter being the adjustment duration as an example, after the adjustment duration has been determined, at the framework layer side, the adjustment duration is stored in the time field of the preset data table in the database. Thus, a process of the application layer process may acquire the adjustment duration by directly monitoring the value in the time field in the data table in the database. In this way, the adjustment duration is transmitted to the application layer process.

Figure 2:
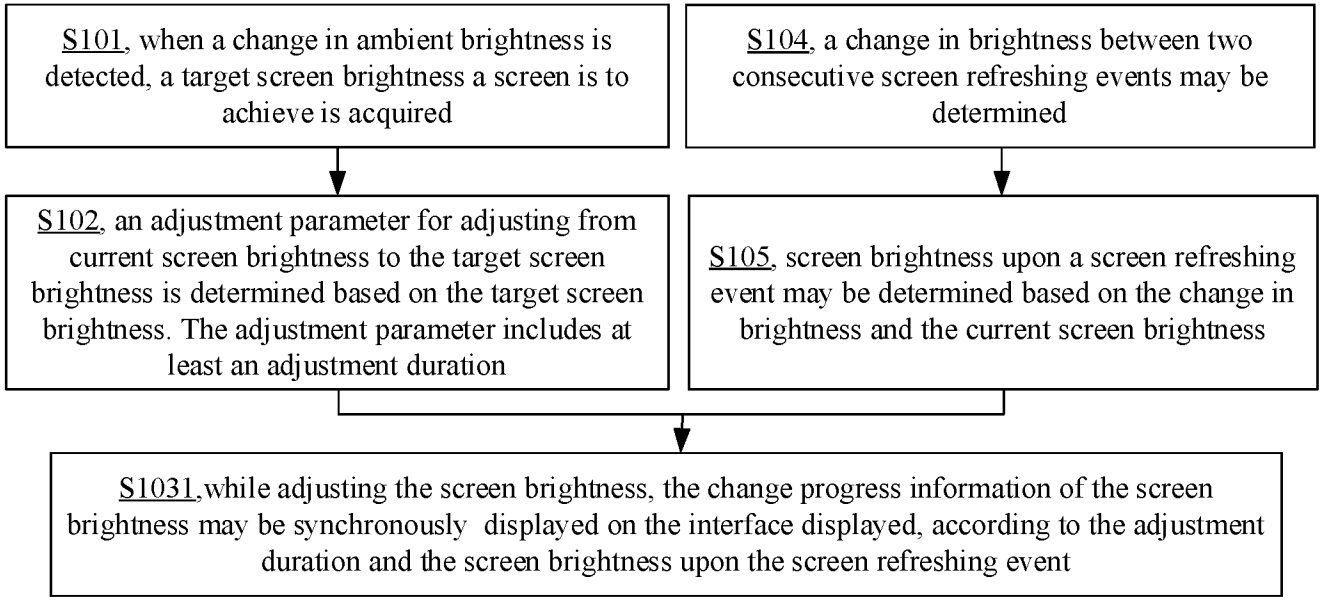
FIG. 2 is a flowchart of a method for adjusting brightness according to an illustrative embodiment.

In some embodiments, FIG. 2 is a flowchart of a method for adjusting brightness according to an illustrative embodiment. As shown in FIG. 2, the method for adjusting brightness further includes a step as follows.

In S104, a change in brightness between two consecutive screen refreshing events may be determined.

In S105, screen brightness upon a screen refreshing event may be determined based on the change in brightness and the current screen brightness.

Here, the screen of the electronic equipment displays information because the screen is refreshed. As the screen is refreshed, the user may see different information on the screen. Based on this principle, the change progress information of the display brightness on the interface displayed may be a segment of animation of the brightness progress bar. That is, the change progress information of the display brightness on the interface displayed is actually formed through screen brightness corresponding to each screen refreshing event.

For example, if the change in the screen brightness start at 8:30:30:20, and completes at 8:30:30:25, that is, within a total time of 5 ms, and if the screen is refreshed at a frequency of 60 HZ, then, the screen will be refreshed five times within the 5 ms, changing by one brightness progress each time. In this way, through the refreshed change, the change progress information of the display brightness on the interface displayed is made to change step by step from the current progress to the target progress.

As another example, the change in the screen brightness start at 8:30:30:20, and completes at 8:30:30:25. The brightness progress bar is at location A at 8:30:30:20. After one screen refreshing event, the brightness progress bar will be at location B at 8:30:30:21, and so on, and the brightness progress bar will be at location E at 8:30:30:25. The sequence of locations A, B, . . . , and E of the brightness progress bar bring about an intuitive animation of the brightness change of the brightness progress bar on the interface displayed.

In this way, with embodiments of the present disclosure, the change progress information of the display brightness on the interface displayed may be synchronized with adjustment of the screen brightness in terms of not only the adjustment duration and the adjustment direction, but also the adjustment rhythm.

Here, the change in brightness between two consecutive screen refreshing events may be determined by a product of a refreshing interval at which the screen is refreshed and a brightness change rate set for the screen.

The time difference between two consecutive screen refreshing events is the refreshing interval for refreshing the screen. For example, if the screen is refreshed at a screen refreshing frequency of 60 HZ, there will be 60 screen refreshing events within 1 S. The refreshing interval of the screen is 1/60S (or 16.67 ms). If the change starts from 0 o'clock, then the first screen refreshing event is at 0 o'clock, and the second screen refreshing event occurs 16.67 ms past 0 o'clock.

Here, if the brightness change rate set for the screen is 5 dbv/S, then the screen brightness is 0.005*16.67 dbv after 16.67 ms. In this way, the change in brightness between two consecutive screen refreshing events may be determined as 0.005*16.67 dbv.

After determining the change in brightness between two consecutive screen refreshing events, screen brightness upon a screen refreshing event may be acquired by adding the change in brightness to the current screen brightness. Thus, the screen brightness upon a screen refreshing event may be determined based on the change in brightness and the current screen brightness as follows. The screen brightness upon a screen refreshing event may be determined according to the sum of the current screen brightness and the change in brightness.

For example, assuming that the change in brightness between two consecutive screen refreshing events is 0.005*16.67 dbv, if the first screen refreshing event is at 0 o'clock, and the current screen brightness at 0 o'clock is 20 dbv, then the screen brightness is 20+0.005*16.67 dbv at the second screen refreshing event, 16.67 ms past 0 o'clock.

In this way, the screen brightness upon each screen refreshing event of the screen is determined, providing a basis for subsequent synchronization of the adjustment rhythm.

In some embodiments, the detected ambient brightness is reported following a reporting period of a multiple of a screen refreshing period.

Here, screen refreshing period=1/screen refreshing frequency.

After the brightness sensor detects and reports the ambient brightness, the processor will give the screen brightness accordingly and perform display corresponding to the screen brightness, and the screen is refreshed following the screen refreshing period. The user may perceive the change in the screen brightness as the screen is constantly refreshed. As the high screen refreshing frequency is imperceptible to the naked eye, by reporting the ambient brightness following a reporting period of a multiple of the screen refreshing period, the ambient brightness is reported at a frequency lower than the screen refreshing frequency, reducing system power consumption.

Moreover, when ambient brightness is reported following a reporting period of a multiple of the screen refreshing period, for the same starting time, the adjustment of the screen brightness may match the screen refreshing frequency, avoiding a problem where due to a reporting period that is not a multiple of the screen refreshing period, display with corresponding brightness cannot be achieved immediately at the reporting moment.

In addition, in some embodiments, the multiple may be 10 to 20.

Since a refreshing period of 0.1 S is perceptible to the naked eye, when the detected ambient brightness is set to be reported following a reporting period 10 to 20 times the screen refreshing period, a clear change in brightness is perceptible to the naked eye.

As shown in FIG. 2, based on S104 to S105, in S103, while adjusting the screen brightness, the change progress information of the screen brightness may be synchronously displayed on the interface displayed, according to the adjustment duration in the adjustment parameter, as follows.

In S1031, while adjusting the screen brightness, the change progress information of the screen brightness may be synchronously displayed on the interface displayed, according to the adjustment duration and the screen brightness upon the screen refreshing event.

Thus, the change progress information of the screen brightness may be displayed on the interface displayed, synchronously with the rate of change in the screen brightness, providing experience of further synchronization, implementing synchronization of not only the adjustment duration and the adjustment direction, but also the adjustment rhythm.

In some embodiments, in S1031, the change progress information of the screen brightness may be synchronously displayed on the interface displayed, according to the adjustment duration and the screen brightness upon the screen refreshing event, as follows.

Adjustment area information corresponding to a brightness adjusting control on the interface displayed may be determined according to the adjustment duration.

Location information of the brightness adjusting control on the interface displayed at the screen refreshing event may be determined according to the screen brightness upon the screen refreshing event.

The change progress information of the screen brightness may be displayed on the interface displayed, based on the adjustment area information and the location information.

It should be noted that the adjustment area information corresponding to the brightness adjusting control on the interface displayed may be determined according to the adjustment duration, as follows. The application layer process may determine, according to the adjustment duration, the adjustment area information corresponding to the brightness adjusting control on the interface displayed.

Correspondingly, the location information of the brightness adjusting control on the interface displayed at the screen refreshing event may be determined according to the screen brightness upon the screen refreshing event, as follows. The application layer process may determine, according to the screen brightness upon the screen refreshing event, the location information of the brightness adjusting control on the interface displayed at the screen refreshing event.

Here, since there may be multiple forms of brightness adjusting controls, each form corresponding to distinct adjustment area information. For example, the adjustment area information corresponding to a brightness progress bar is to be strip-shaped area information. The adjustment area information corresponding to a brightness progress ball is to be sector-shaped area information.

Specific representation of corresponding adjustment area information on the brightness adjusting control may differ with different adjustment durations and adjustment directions. For example, when the adjustment duration is 5 ms and the adjustment direction is the brightness increase direction, the adjustment area information corresponding to a brightness progress bar is area information for a strip of a length of 20 mm, and the direction of change for the strip-shaped area information is to the right, and the adjustment area information corresponding to a brightness progress ball is of a sector area of an angle of 20 degrees, and the direction of change for the sector area is clockwise (assuming that the clockwise direction is the brightness increase direction).

Further, time of different screen refreshing events may correspond to different location information on the brightness adjusting control. Location information represents the location of the current display progress on the brightness adjusting control. Different location information may correspond to different screen brightness. For example, when the brightness progress is at the left most end on the brightness progress bar, it means that the screen brightness is minimal at the moment. When the brightness progress is at the rightmost end of the brightness progress bar, it means that the screen brightness is maximal at the moment.

Thus, after the adjustment area information and the location information have been acquired, the change progress information of the screen brightness may be displayed on the interface displayed, corresponding to the adjustment area information and the location information, bringing about a more intuitive user experience of visual synchronization.

In some embodiments, when the electronic equipment is set to display brightness change information, the steps of the method for adjusting brightness of embodiments of the present disclosure are performed, and when the electronic equipment is set to not display the brightness change information, the brightness change information is not displayed on the screen accordingly.

Here, before embodiments of the present disclosure are implemented, it may be activated in system setting to display the brightness change information. In this way, the brightness change information may be displayed on the screen synchronously with adaptation of the screen brightness to a detected change in ambient brightness. In this way, it is possible to determine whether to display the brightness change information as needed by the user, increasing other possible applications, as well as improving the user experience.

Embodiments of the present disclosure also provide examples as follows.

Figure 3:
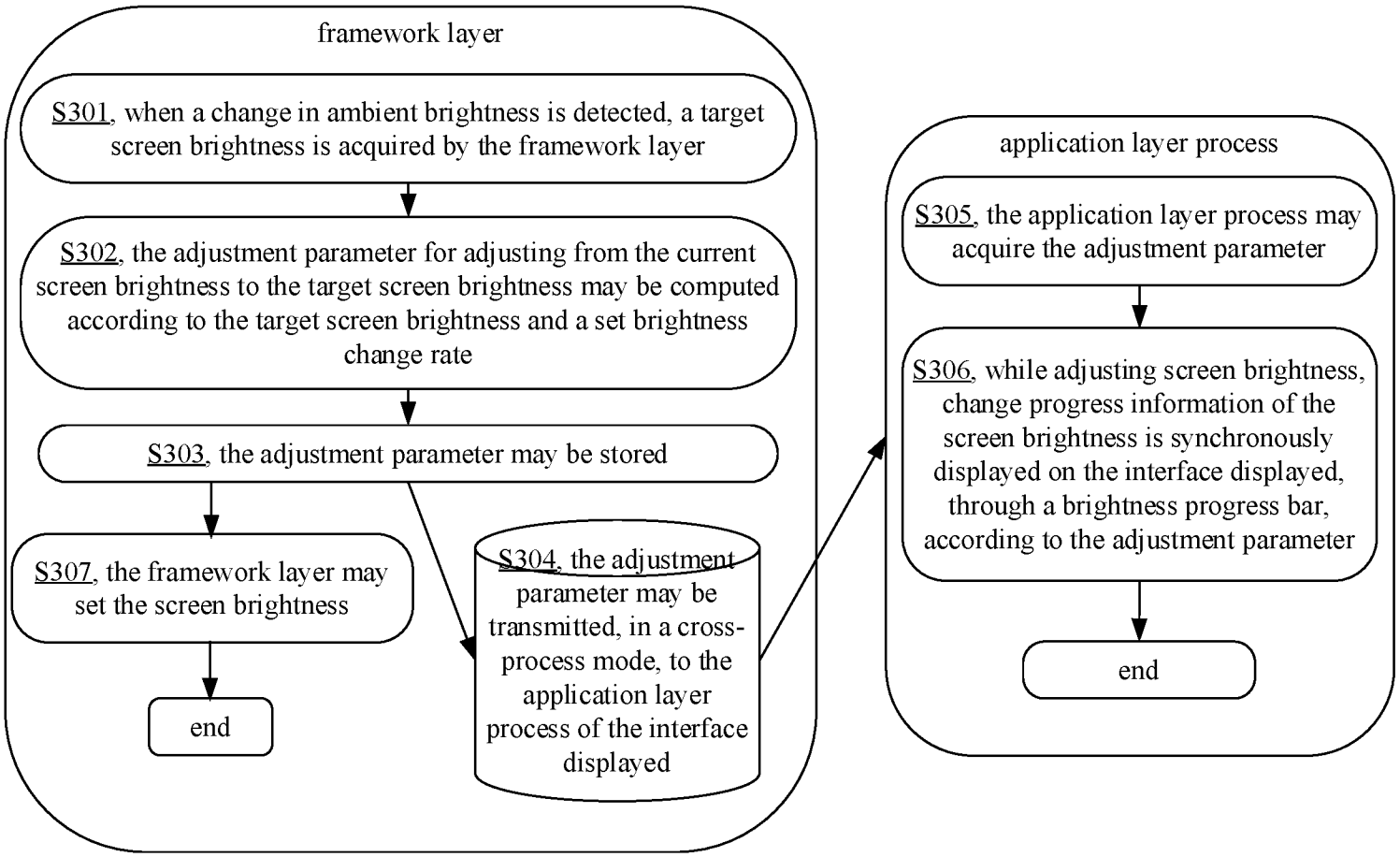
FIG. 3 is a flowchart of a method for adjusting brightness according to an illustrative embodiment.

FIG. 3 is a flowchart of a method for adjusting brightness according to an illustrative embodiment.

In S301, when a change in ambient brightness is detected, a target screen brightness is acquired by the framework layer.

In S302, the adjustment parameter for adjusting from the current screen brightness to the target screen brightness may be computed according to the target screen brightness and a set brightness change rate.

In S303, the adjustment parameter may be stored.

In S304, the adjustment parameter may be transmitted, in a cross-process mode, to the application layer process of the interface displayed.

In S305, the application layer process may acquire the adjustment parameter.

In S306, while adjusting screen brightness, change progress information of the screen brightness is synchronously displayed on the interface displayed by the application layer, through a brightness progress bar, according to the adjustment parameter.

In S307, the framework layer may set the screen brightness.

Here, S307 may be performed after S303.

Here, the adjustment parameter for adjusting from the current screen brightness to the target screen brightness may be computed as follows.

First, a brightness change rate for changing the screen brightness, i.e., the set brightness change rate, may be set in the electronic equipment.

Based on the set brightness change rate, the change in brightness corresponding to one screen refreshing event (i.e., the change in brightness between two consecutive screen refreshing events)=frame update interval*brightness change rate.

The number of refreshing events required to adjust from initial brightness (current screen brightness) to the target screen brightness=difference between the target screen brightness and the current screen brightness/change in brightness corresponding to one screen refreshing event.

The time required for each display of brightness on the screen=the frame update interval.

Then, the adjustment duration in the adjustment parameter for adjusting from the current screen brightness to the target screen brightness=difference between the target screen brightness and the current screen brightness/set brightness change rate.

Next, in S304, the framework layer stores the determined adjustment parameter in the data table Settings.System in the database through a component Content provider. The application layer process of the application side monitors the corresponding field through a set component Content Observer, so that whenever there is a change in the value of the field in the Settings.System, the application layer process (System UI) of the application side will receive the change.

Finally, in S306, after receiving the update of the data table in the framework layer, the application layer process (System UI) of the application side will acquire the adjustment parameter, and then take the adjustment parameter as the adjustment parameter for animating the brightness progress bar. Thus, animation of the brightness progress bar will conclude exactly upon completion of the change in the screen brightness, synchronizing the progress on the brightness bar and the actual screen brightness setting.

Figure 4:
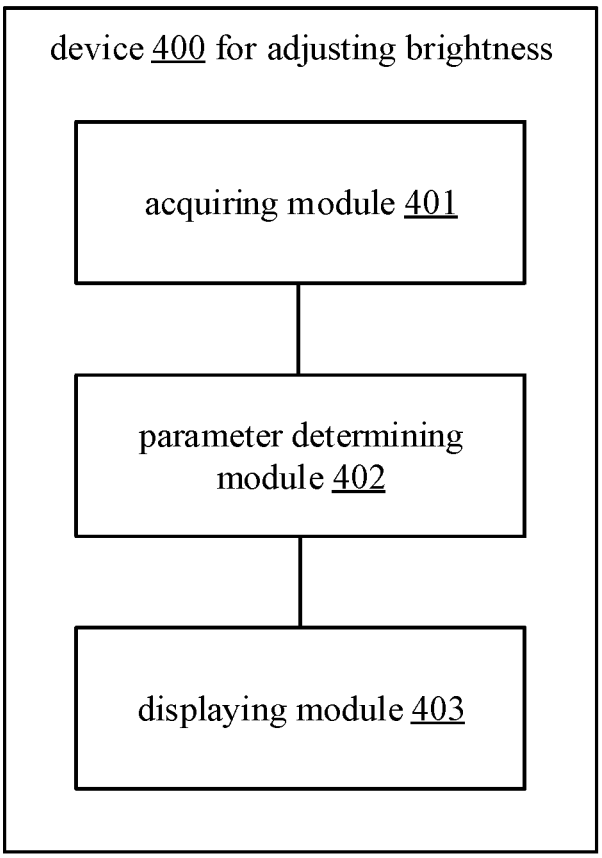
FIG. 4 is a schematic diagram of a structure of a device for adjusting brightness according to an illustrative embodiment.

Embodiments of the present disclosure also provide a device for adjusting brightness. FIG. 4 is a schematic diagram of a structure of a device for adjusting brightness according to an illustrative embodiment. As shown in FIG. 4, the device for adjusting brightness 400 includes modules as follows.

An acquiring module 401 is configured to, in response to detecting a change in ambient brightness, acquire a target screen brightness a screen is to achieve.

A parameter determining module 402 is configured to determine, based on the target screen brightness, an adjustment parameter for adjusting from current screen brightness to the target screen brightness. The adjustment parameter includes at least an adjustment duration.

A displaying module 403 is configured to, while adjusting screen brightness, synchronously display, according to the adjustment duration in the adjustment parameter, change progress information of the screen brightness on an interface displayed.

In some embodiments, the adjustment duration indicates a total amount of time required to adjust from the current screen brightness to the target screen brightness.

The displaying module may be is further configured to synchronously display, on the interface displayed, within the adjustment duration of adjusting the screen brightness, the change progress information of a duration same as the adjustment duration.

In some embodiments, the parameter determining module includes:

an adjustment amount determining module configured to determine, based on the target screen brightness and the current screen brightness, a to-be-achieved adjustment amount of the screen brightness; and a duration determining module configured to determine, based on the to-be-achieved adjustment amount and a set brightness change rate, the adjustment duration required to adjust to the target screen brightness.

In some embodiments, the adjustment parameter further includes an adjustment direction.

The adjustment direction may include a brightness increase direction or a brightness decrease direction.

The displaying module may be further configured to, while adjusting the screen brightness, synchronously display, on the interface displayed, the change progress information of adjusting the screen brightness in the adjustment direction.

In some embodiments, the parameter determining module includes:

a direction determining module configured to determine the adjustment direction based on a relation between magnitudes of the target screen brightness and the current screen brightness.

In some embodiments, the device further includes:

a transmitting module configured to transmit, through a framework layer, the adjustment parameter to an application layer process of the interface displayed on the screen.

The displaying module may be further configured to, while adjusting screen brightness, synchronously display, through the application layer process according to the adjustment duration in the adjustment parameter, the change progress information of the screen brightness on the interface displayed.

In some embodiments, the transmission module includes:

a storing module configured to store, through the framework layer, the adjustment parameter in a target field of a preset data table; and a parameter acquiring module configured to acquire, through the application layer process, the adjustment parameter by monitoring a value of the target field.

In some embodiments, the device further includes:

a change determining module configured to determine a change in brightness between two consecutive screen refreshing events; and a brightness determining module configured to determine, based on the change in brightness and the current screen brightness, screen brightness upon a screen refreshing event.

The displaying module may further include:

a first displaying module configured to, while adjusting the screen brightness, synchronously display, according to the adjustment duration and the screen brightness upon the screen refreshing event, the change progress information of the screen brightness on the interface displayed.

In some embodiments, the first displaying module includes:

an area information determining module configured to determine, according to the adjustment duration, adjustment area information corresponding to a brightness adjusting control on the interface displayed;

a location information determining module configured to determine, according to the screen brightness upon the screen refreshing event, location information of the brightness adjusting control on the interface displayed, at the screen refreshing event; and a second displaying module configured to display, based on the adjustment area information and the location information, the change progress information of the screen brightness on the interface displayed.

A module of the device according to an aforementioned embodiment herein may perform an operation in a mode elaborated in an aforementioned embodiment of the method herein, which will not be repeated here.

Figure 5:
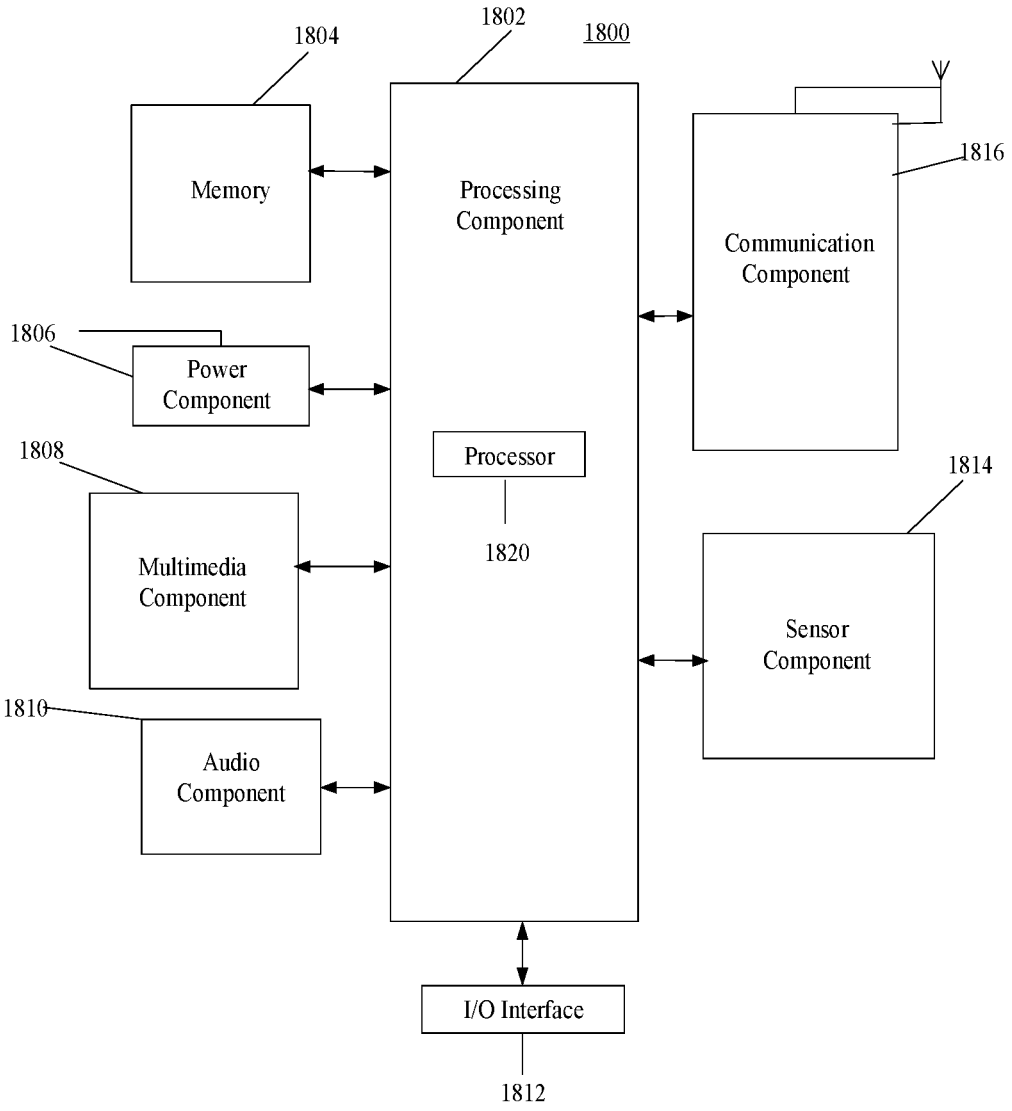
FIG. 5 is a block diagram of a device for adjusting brightness according to an illustrative embodiment.

FIG. 5 is a block diagram of a device 1800 for adjusting brightness according to an illustrative embodiment. For example, the device 1800 may be a terminal such as a mobile phone, a computer, a digital broadcasting terminal, messaging equipment, a game console, tablet equipment, medical equipment, fitness equipment, a Personal Digital Assistant (PDA), etc.

Referring to FIG. 5, the device 1800 may include one or more components as follows: a processing component 1802, a memory 1804, a power component 1806, a multimedia component 1808, an audio component 1810, an Input/Output (I/O) interface 1812, a sensor component 1814, and a communication component 1816.

The processing component 1802 generally controls an overall operation of the display equipment, such as operations associated with display, a telephone call, data communication, a camera operation, a recording operation, etc. The processing component 1802 may include one or more processors 1820 to execute instructions so as to complete all or some steps of the method. In addition, the processing component 1802 may include one or more modules to facilitate interaction between the processing component 1802 and other components. For example, the processing component 1802 may include a multimedia module to facilitate interaction between the multimedia component 1808 and the processing component 1802.

The memory 1804 is configured to store various types of data to support operation on the device 1800. Examples of these data include instructions of any application or method configured to operate on the device 1800, contact data, phonebook data, messages, pictures, videos, and/or the like. The memory 1804 may be realized by any type of volatile or non-volatile storage equipment or combination thereof, such as Static Random Access Memory (SRAM), Electrically Erasable Programmable Read-Only Memory (EEPROM), Erasable Programmable Read-Only Memory (EPROM), Programmable Read-Only Memory (PROM), Read-Only Memory (ROM), magnetic memory, flash memory, magnetic disk, or compact disk.

The power component 1806 supplies electric power to various components of the device 1800. The power component 1806 may include a power management system, one or more power supplies, and other components related to generating, managing and distributing electric power for the device 1800.

The multimedia component 1808 includes a screen providing an output interface between the device 1800 and a user. The screen may include a Liquid Crystal Display (LCD) and a Touch Panel (TP). If the screen includes a TP, the screen may be realized as a touch screen to receive an input signal from a user. The TP includes one or more touch sensors for sensing touch, slide and gestures on the TP. The touch sensors not only may sense the boundary of a touch or slide move, but also detect the duration and pressure related to the touch or slide move. In some embodiments, the multimedia component 1808 includes a front camera and/or a rear camera. When the device 1800 is in an operation mode such as a shooting mode or a video mode, the front camera and/or the rear camera may receive external multimedia data. Each of the front camera and/or the rear camera may be a fixed optical lens system or may have a focal length and be capable of optical zooming.

The audio component 1810 is configured to output and/or input an audio signal. For example, the audio component 1810 includes a microphone (MIC). When the device 1800 is in an operation mode such as a call mode, a recording mode, and a voice recognition mode, the MIC is configured to receive an external audio signal. The received audio signal may be further stored in the memory 1804 or may be sent via the communication component 1816. In some embodiments, the audio component 1810 further includes a loudspeaker configured to output the audio signal.

The I/O interface 1812 provides an interface between the processing component 1802 and a peripheral interface module. The peripheral interface module may be a keypad, a click wheel, a button or the like. These buttons may include but are not limited to: a homepage button, a volume button, a start button, and a lock button.

The sensor component 1814 includes one or more sensors for assessing various states of the device 1800. For example, the sensor component 1814 may detect an on/off state of the device 1800 and relative locationing of components such as the display and the keypad of the device 1800. The sensor component 1814 may further detect a change in the location of the device 1800 or of a component of the device 1800, whether there is contact between the device 1800 and a user, the orientation or acceleration/deceleration of the device 1800, and a change in the temperature of the device 1800. The sensor component 1814 may include a proximity sensor configured to detect existence of a nearby object without physical contact. The sensor component 1814 may further include an optical sensor such as a Complementary Metal-Oxide-Semiconductor (CMOS) or Charge-Coupled-Device (CCD) image sensor used in an imaging application. In some embodiments, the sensor component 1814 may further include an acceleration sensor, a gyroscope sensor, a magnetic sensor, a pressure sensor, or a temperature sensor.

The communication component 1816 is configured to facilitate wired or wireless/radio communication between the device 1800 and other equipment. The device 1800 may access a radio network based on a communication standard such as WiFi, 2G, 3G, . . . , or a combination thereof. In an illustrative embodiment, the communication component 1816 broadcasts related information or receives a broadcast signal from an external broadcast management system via a broadcast channel. In an illustrative embodiment, the communication component 1816 further includes a Near Field Communication (NFC) module for short-range communication. For example, the NFC module may be realized based on Radio Frequency Identification (RFID), Infrared Data Association (IrDA), Ultra-WideBand (UWB) technology, BlueTooth (BT) technology, and other technologies.

In an illustrative embodiment, the device 1800 may be realized by one or more of Application Specific Integrated Circuits (ASIC), Digital Signal Processors (DSP), Digital Signal Processing Device (DSPD), Programmable Logic Devices (PLD), Field Programmable Gate Arrays (FPGA), controllers, microcontrollers, microprocessors or other electronic components, to implement the method.

In an illustrative embodiment, a transitory or non-transitory computer-readable storage medium including instructions, such as the memory 1804 including instructions, is further provided. The instructions may be executed by the processor 1820 of the device 1800 to implement the method. For example, the computer-readable storage medium may be a Read-Only Memory (ROM), a Random Access Memory (RAM), a Compact Disc Read-Only Memory (CD-ROM), a magnetic tape, a floppy disk, optical data storage equipment, etc.

A transitory or non-transitory computer-readable storage medium has stored therein instructions which, when executed by a processor, implement a method for adjusting brightness herein.

Further note that herein by "multiple", it may mean two or more. Other quantifiers may have similar meanings. A term "and/or" may describe an association between associated objects, indicating three possible relationships. For example, by A and/or B, it may mean that there may be three cases, namely, existence of but A, existence of both A and B, or existence of but B. A slash mark "/" may generally denote an "or" relationship between two associated objects that come respectively before and after the slash mark. Singulars "a/an", "said" and "the" are intended to include the plural form, unless expressly illustrated otherwise by context.

Further note that although in drawings herein operations are described in a specific or der, it should not be construed as that the operations have to be performed in the specific or der or sequence, or that any operation shown has to be performed in or der to acquire an expected result. Under a specific circumstance, multitask and parallel processing may be advantageous.

Other implementations of the present disclosure will be apparent to a person having ordinary skill in the art that has considered the specification and practiced the present disclosure. The present disclosure is intended to cover any variation, use, or adaptation of the present disclosure following the general principles of the present disclosure and including such departures from the present disclosure as come within common knowledge or customary practice in the art. The specification and the embodiments are intended to be illustrative only, with a true scope and spirit of the present disclosure being indicated by the appended claims.

It should be understood that the present disclosure is not limited to the exact construction that has been described above and illustrated in the accompanying drawings, and that various modifications and changes can be made to the present disclosure without departing from the scope of the present disclosure. It is intended that the scope of the present disclosure is limited only by the appended claims.

According to an aspect of embodiments of the present disclosure, there is provided a method for adjusting brightness, including: in response to detecting a change in ambient brightness, acquiring a target screen brightness a screen is to achieve; determining, based on the target screen brightness, an adjustment parameter for adjusting from current screen brightness to the target screen brightness, the adjustment parameter including at least an adjustment duration; and while adjusting screen brightness, synchronously displaying, according to the adjustment duration in the adjustment parameter, change progress information of the screen brightness on an interface displayed.

According to an embodiment of the present disclosure, the adjustment duration indicates a total amount of time required to adjust from the current screen brightness to the target screen brightness.

The while adjusting the screen brightness, synchronously displaying, according to the adjustment duration in the adjustment parameter, the change progress information of the screen brightness on the interface displayed, may include: synchronously displaying, on the interface displayed, within the adjustment duration of adjusting the screen brightness, the change progress information of a duration same as the adjustment duration.

According to an embodiment of the present disclosure, determining, based on the target screen brightness, the adjustment parameter for adjusting from the current screen brightness to the target screen brightness includes: determining, based on the target screen brightness and the current screen brightness, a to-be-achieved adjustment amount of the screen brightness; and determining, based on the to-be-achieved adjustment amount and a set brightness change rate, the adjustment duration required to adjust to the target screen brightness.

According to an embodiment of the present disclosure, the adjustment parameter further includes an adjustment direction. The adjustment direction may include a brightness increase direction or a brightness decrease direction.

According to an embodiment of the present disclosure, the while adjusting the screen brightness, synchronously displaying, according to the adjustment duration in the adjustment parameter, the change progress information of the screen brightness on the interface displayed, may include: while adjusting the screen brightness, synchronously displaying, on the interface displayed, the change progress information of adjusting the screen brightness in the adjustment direction.

According to an embodiment of the present disclosure, determining, based on the target screen brightness, the adjustment parameter for adjusting from the current screen brightness to the target screen brightness includes: determining the adjustment direction based on a relation between magnitudes of the target screen brightness and the current screen brightness.

According to an embodiment of the present disclosure, the method further includes: transmitting, by a framework layer, the adjustment parameter to an application layer process of the interface displayed on the screen.

According to an embodiment of the present disclosure, the while adjusting the screen brightness, synchronously displaying, according to the adjustment duration in the adjustment parameter, the change progress information of the screen brightness on the interface displayed, may include: while adjusting the screen brightness, synchronously displaying, by the application layer process according to the adjustment duration in the adjustment parameter, the change progress information of the screen brightness on the interface displayed.

According to an embodiment of the present disclosure, transmitting, by the framework layer, the adjustment parameter to the application layer process of the interface displayed on the screen includes: storing, by the framework layer, the adjustment parameter in a target field of a preset data table; and acquiring, by the application layer process, the adjustment parameter by monitoring a value of the target field.

According to an embodiment of the present disclosure, the method further includes: determining a change in brightness between two consecutive screen refreshing events; and determining, based on the change in brightness and the current screen brightness, screen brightness upon a screen refreshing event.

The while adjusting the screen brightness, synchronously displaying, according to the adjustment duration in the adjustment parameter, the change progress information of the screen brightness on the interface displayed, may include: while adjusting the screen brightness, synchronously displaying, according to the adjustment duration and the screen brightness upon the screen refreshing event, the change progress information of the screen brightness on the interface displayed.

According to an embodiment of the present disclosure, synchronously displaying, according to the adjustment duration and the screen brightness upon the screen refreshing event, the change progress information of the screen brightness on the interface displayed, may include: determining, according to the adjustment duration, adjustment area information corresponding to a brightness adjusting control on the interface displayed; determining, according to the screen brightness upon the screen refreshing event, location information of the brightness adjusting control on the interface displayed, at the screen refreshing event; and displaying, based on the adjustment area information and the location information, the change progress information of the screen brightness on the interface displayed.

According to an aspect of embodiments of the present disclosure, there is provided a device for adjusting brightness, including: an acquiring module configured to, in response to detecting a change in ambient brightness, acquire a target screen brightness a screen is to achieve; a parameter determining module configured to determine, based on the target screen brightness, an adjustment parameter for adjusting from current screen brightness to the target screen brightness, the adjustment parameter including at least an adjustment duration; and a displaying module configured to, while adjusting screen brightness, synchronously display, according to the adjustment duration in the adjustment parameter, change progress information of the screen brightness on an interface displayed.

According to an embodiment of the present disclosure, the adjustment duration indicates a total amount of time required to adjust from the current screen brightness to the target screen brightness.

The displaying module may be further configured to synchronously display, on the interface displayed, within the adjustment duration of adjusting the screen brightness, the change progress information of a duration same as the adjustment duration.

According to an embodiment of the present disclosure, the parameter determining module includes: an adjustment amount determining module configured to determine, based on the target screen brightness and the current screen brightness, a to-be-achieved adjustment amount of the screen brightness; and a duration determining module configured to determine, based on the to-be-achieved adjustment amount and a set brightness change rate, the adjustment duration required to adjust to the target screen brightness.

According to an embodiment of the present disclosure, the adjustment parameter further includes an adjustment direction. The adjustment direction may include a brightness increase direction or a brightness decrease direction.

The displaying module may be further configured to, while adjusting the screen brightness, synchronously display, on the interface displayed, the change progress information of adjusting the screen brightness in the adjustment direction.

According to an embodiment of the present disclosure, the parameter determining module includes: a direction determining module configured to determine the adjustment direction based on a relation between magnitudes of the target screen brightness and the current screen brightness.

According to an embodiment of the present disclosure, the device further includes: a transmitting module configured to transmit, through a framework layer, the adjustment parameter to an application layer process of the interface displayed on the screen.

The displaying module may be further configured to, while adjusting screen brightness, synchronously display, through the application layer process according to the adjustment duration in the adjustment parameter, the change progress information of the screen brightness on the interface displayed.

According to an embodiment of the present disclosure, the transmitting module includes: a storing module configured to store, through the framework layer, the adjustment parameter in a target field of a preset data table; and a parameter acquiring module configured to acquire, through the application layer process, the adjustment parameter by monitoring a value of the target field.

According to an embodiment of the present disclosure, the device further includes: a change determining module configured to determine a change in brightness between two consecutive screen refreshing events; and a brightness determining module configured to determine, based on the change in brightness and the current screen brightness, screen brightness upon a screen refreshing event.

The displaying module may further include: a first displaying module configured to, while adjusting the screen brightness, synchronously display, according to the adjustment duration and the screen brightness upon the screen refreshing event, the change progress information of the screen brightness on the interface displayed.

According to an embodiment of the present disclosure, the first displaying module includes: an area information determining module configured to determine, according to the adjustment duration, adjustment area information corresponding to a brightness adjusting control on the interface displayed; a location information determining module configured to determine, according to the screen brightness upon the screen refreshing event, location information of the brightness adjusting control on the interface displayed, at the screen refreshing event; and a second displaying module configured to display, based on the adjustment area information and the location information, the change progress information of the screen brightness on the interface displayed.

According to an aspect of embodiments of the present disclosure, there is provided a device for adjusting brightness, including: a processor; and a memory for storing processor executable instructions.

The processor is configured to implement any method herein by executing the executable instructions stored in the memory.

According to an aspect of embodiments of the present disclosure, there is provided a non-transitory computer-readable storage medium having stored therein computer-executable instructions which, when executed by a processor, implement a step of any method herein.

What is claimed is:

1. A method for adjusting brightness, comprising:

in response to detecting a change in ambient brightness, acquiring a target screen brightness;

determining, based on the target screen brightness, an adjustment parameter for adjusting a screen from current screen brightness to the target screen brightness, the adjustment parameter comprising at least an adjustment duration;

in response to adjusting screen brightness, synchronously displaying, according to the adjustment duration in the adjustment parameter, change progress information of the screen brightness on an interface displayed on the screen;

determining a change in brightness between two consecutive screen refreshing events; and determining, based on the change in brightness and the current screen brightness, screen brightness upon a screen refreshing event, wherein in response to adjusting the screen brightness, synchronously displaying, according to the adjustment duration in the adjustment parameter, the change progress information of the screen brightness on the interface displayed on the screen comprises:

in response to adjusting the screen brightness, synchronously displaying, according to the adjustment duration and the screen brightness upon the screen refreshing event, the change progress information of the screen brightness on the interface displayed, wherein synchronously displaying, according to the adjustment duration and the screen brightness upon the screen refreshing event, the change progress information of the screen brightness on the interface displayed comprises:

determining, according to the adjustment duration, adjustment area information corresponding to a brightness adjusting control on the interface displayed;

determining, according to the screen brightness upon the screen refreshing event, location information of the brightness adjusting control on the interface displayed, at the screen refreshing event; and displaying, based on the adjustment area information and the location information, the change progress information of the screen brightness on the interface displayed.

2. The method of claim 1, wherein the adjustment duration indicates a total amount of time required to adjust the screen from the current screen brightness to the target screen brightness, wherein in response to adjusting the screen brightness, synchronously displaying, according to the adjustment duration in the adjustment parameter, the change progress information of the screen brightness on the interface displayed on the screen comprises:

synchronously displaying, on the interface displayed, within the adjustment duration of adjusting the screen brightness, the change progress information of a duration same as the adjustment duration.

3. The method of claim 1, wherein determining, based on the target screen brightness, the adjustment parameter for adjusting the screen from the current screen brightness to the target screen brightness comprises:

determining, based on the target screen brightness and the current screen brightness, a to-be-achieved adjustment amount of the screen brightness; and determining, based on the to-be-achieved adjustment amount and a set brightness change rate, the adjustment duration required to adjust to the target screen brightness.

4. The method of claim 1, wherein the adjustment parameter further comprises an adjustment direction comprising a brightness increase direction or a brightness decrease direction, wherein in response to adjusting the screen brightness, synchronously displaying, according to the adjustment duration in the adjustment parameter, the change progress information of the screen brightness on the interface displayed on the screen comprises:

in response to adjusting the screen brightness, synchronously displaying, on the interface displayed, the change progress information of adjusting the screen brightness in the adjustment direction.

5. The method of claim 1, wherein determining, based on the target screen brightness, the adjustment parameter for adjusting the screen from the current screen brightness to the target screen brightness comprises:

determining an adjustment direction based on a relation between magnitudes of the target screen brightness and the current screen brightness.

6. The method of claim 1, further comprising:

transmitting, by a framework layer, the adjustment parameter to an application layer process of the interface displayed on the screen, wherein in response to adjusting the screen brightness, synchronously displaying, according to the adjustment duration in the adjustment parameter, the change progress information of the screen brightness on the interface displayed on the screen comprises:

in response to adjusting the screen brightness, synchronously displaying, by the application layer process and according to the adjustment duration in the adjustment parameter, the change progress information of the screen brightness on the interface displayed.

7. The method of claim 6, wherein transmitting, by the framework layer, the adjustment parameter to the application layer process of the interface displayed on the screen comprises:

storing, by the framework layer, the adjustment parameter in a target field of a preset data table; and acquiring, by the application layer process, the adjustment parameter by monitoring a value of the target field.

8. A device for adjusting brightness, comprising:

a processor and a memory for storing executable instructions executable on the processor, wherein the processor is configured to execute the executable instructions to perform acts comprising:

in response to detecting a change in ambient brightness, acquiring a target screen brightness;

determining, based on the target screen brightness, an adjustment parameter for adjusting a screen from current screen brightness to the target screen brightness, the adjustment parameter comprising at least an adjustment duration;

in response to adjusting screen brightness, synchronously displaying, according to the adjustment duration in the adjustment parameter, change progress information of the screen brightness on an interface displayed on the screen;

determining a change in brightness between two consecutive screen refreshing events; and determining, based on the change in brightness and the current screen brightness, screen brightness upon a screen refreshing event, wherein the processor is configured to perform in response to adjusting the screen brightness, synchronously displaying, according to the adjustment duration in the adjustment parameter, the change progress information of the screen brightness on the interface displayed on the screen by:

in response to adjusting the screen brightness, synchronously displaying, according to the adjustment duration and the screen brightness upon the screen refreshing event, the change progress information of the screen brightness on the interface displayed, wherein the processor is configured to perform synchronously displaying, according to the adjustment duration and the screen brightness upon the screen refreshing event, the change progress information of the screen brightness on the interface displayed on the screen by:

determining, according to the adjustment duration, adjustment area information corresponding to a brightness adjusting control on the interface displayed;

determining, according to the screen brightness upon the screen refreshing event, location information of the brightness adjusting control on the interface displayed, at the screen refreshing event; and displaying, based on the adjustment area information and the location information, the change progress information of the screen brightness on the interface displayed.

9. The device of claim 8, wherein the adjustment duration indicates a total amount of time required to adjust the screen from the current screen brightness to the target screen brightness, wherein the processor is configured to perform in response to adjusting the screen brightness, synchronously displaying, according to the adjustment duration in the adjustment parameter, the change progress information of the screen brightness on the interface displayed on the screen by:

synchronously displaying, on the interface displayed, within the adjustment duration of adjusting the screen brightness, the change progress information of a duration same as the adjustment duration.

10. The device of claim 8, wherein the processor is configured to perform determining, based on the target screen brightness, the adjustment parameter for adjusting the screen from the current screen brightness to the target screen brightness by:

determining, based on the target screen brightness and the current screen brightness, a to-be-achieved adjustment amount of the screen brightness; and determining, based on the to-be-achieved adjustment amount and a set brightness change rate, the adjustment duration required to adjust to the target screen brightness.

11. The device of claim 8, wherein the adjustment parameter further comprises:

an adjustment direction comprising a brightness increase direction or a brightness decrease direction, wherein the processor is configured to perform in response to adjusting the screen brightness, synchronously displaying, according to the adjustment duration in the adjustment parameter, the change progress information of the screen brightness on the interface displayed on the screen by:

in response to adjusting the screen brightness, synchronously displaying, on the interface displayed, the change progress information of adjusting the screen brightness in the adjustment direction.

12. The device of claim 8, wherein the processor is configured to perform determining, based on the target screen brightness, the adjustment parameter for adjusting the screen from the current screen brightness to the target screen brightness by:

determining an adjustment direction based on a relation between magnitudes of the target screen brightness and the current screen brightness.

13. The device of claim 8, wherein the processor is further configured to perform:

transmitting, through a framework layer, the adjustment parameter to an application layer process of the interface displayed on the screen, wherein the processor is further configured to perform in response to adjusting the screen brightness, synchronously displaying, according to the adjustment duration in the adjustment parameter, the change progress information of the screen brightness on the interface displayed on the screen by:

in response to adjusting the screen brightness, synchronously displaying, through the application layer process and according to the adjustment duration in the adjustment parameter, the change progress information of the screen brightness on the interface displayed.

14. The device of claim 13, wherein the processor is configured to perform transmitting, through the framework layer, the adjustment parameter to the application layer process of the interface displayed on the screen by:

storing, through the framework layer, the adjustment parameter in a target field of a preset data table; and acquiring, through the application layer process, the adjustment parameter by monitoring a value of the target field.

15. A non-transitory computer-readable storage medium having stored therein computer-executable instructions which, when executed by a processor, implement acts comprising:

in response to detecting a change in ambient brightness, acquiring a target screen brightness;

determining, based on the target screen brightness, an adjustment parameter for adjusting a screen from current screen brightness to the target screen brightness, the adjustment parameter comprising at least an adjustment duration;

in response to adjusting screen brightness, synchronously displaying, according to the adjustment duration in the adjustment parameter, change progress information of the screen brightness on an interface displayed on the screen;

determining a change in brightness between two consecutive screen refreshing events; and determining, based on the change in brightness and the current screen brightness, screen brightness upon a screen refreshing event, wherein in response to adjusting the screen brightness, synchronously displaying, according to the adjustment duration in the adjustment parameter, the change progress information of the screen brightness on the interface displayed on the screen comprises:

in response to adjusting the screen brightness, synchronously displaying, according to the adjustment duration and the screen brightness upon the screen refreshing event, the change progress information of the screen brightness on the interface displayed, wherein synchronously displaying, according to the adjustment duration and the screen brightness upon the screen refreshing event, the change progress information of the screen brightness on the interface displayed comprises:

determining, according to the adjustment duration, adjustment area information corresponding to a brightness adjusting control on the interface displayed;

determining, according to the screen brightness upon the screen refreshing event, location information of the brightness adjusting control on the interface displayed, at the screen refreshing event; and displaying, based on the adjustment area information and the location information, the change progress information of the screen brightness on the interface displayed.

16. The storage medium of claim 15, wherein the adjustment duration indicates a total amount of time required to adjust the screen from the current screen brightness to the target screen brightness, wherein in response to adjusting the screen brightness, synchronously displaying, according to the adjustment duration in the adjustment parameter, the change progress information of the screen brightness on the interface displayed on the screen comprises:

synchronously displaying, on the interface displayed, within the adjustment duration of adjusting the screen brightness, the change progress information of a duration same as the adjustment duration.

* * * * *